US005249330A

United States Patent [19]

Janssen

[11] Patent Number: 5,249,330

[45] Date of Patent: Oct. 5, 1993

[54] PAINT ROLLER APPLICATORS

[76] Inventor: Robert I. Janssen, 1160 Sibley Hwy., Mendota Heights, Minn. 55118

[21] Appl. No.: 891,927

[22] Filed: Jun. 1, 1992

Related U.S. Application Data

[63] Continuation of Ser. No. 706,368, May 28, 1991, abandoned.

[51] Int. Cl.[5] ..... A46B 5/02; A47K 7/02; A47L 1/00

[52] U.S. Cl. ..... 15/230.11; 15/143.1; 15/246; 434/219; 492/13

[58] Field of Search ..... 15/114, 145, 146, 143 R, 15/230.11, 246; 29/110.5, 120

[56] References Cited

U.S. PATENT DOCUMENTS

| | | | |
|---|---|---|---|
| D. 291,152 | 8/1987 | Bay . | |
| 290,813 | 12/1883 | Sweetser | 29/110.5 |
| 352,351 | 11/1886 | Pope | 29/110.5 |
| 2,526,756 | 10/1950 | Krebs | 15/145 |
| 2,662,240 | 12/1953 | Perkins | 15/246 |
| 2,669,742 | 2/1954 | Coughlan . | |
| 2,747,210 | 5/1956 | Canning . | |
| 2,854,684 | 10/1958 | Hardman . | |
| 2,873,463 | 2/1959 | Nunes | 15/246 |
| 2,946,073 | 7/1960 | Vosbikian | 15/230.11 |
| 2,984,853 | 5/1961 | Williams | 15/145 |
| 3,027,582 | 4/1962 | Pittman | 15/230.11 |
| 3,228,087 | 1/1966 | Stoddart . | |
| 3,386,119 | 6/1968 | Shulman . | |
| 3,447,184 | 6/1969 | McGinley . | |
| 3,711,887 | 1/1973 | Chapman . | |
| 3,751,748 | 8/1973 | Roe | 15/230.11 |
| 3,877,123 | 4/1975 | Pharris . | |
| 4,209,883 | 7/1980 | Hawk . | |
| 4,237,575 | 12/1980 | Mlachnik | 15/230.11 |
| 4,316,031 | 2/1982 | Smith . | |
| 4,387,478 | 6/1983 | Smith | 15/230.11 |
| 4,821,361 | 4/1989 | Meimeteas | 15/246 |
| 4,897,893 | 2/1990 | Barker | 29/110.5 |

FOREIGN PATENT DOCUMENTS

| | | | |
|---|---|---|---|
| 46996 | 3/1938 | Netherlands | 15/174 |
| 223935 | 12/1968 | Sweden | 15/246 |

*Primary Examiner*—Chris K. Moore
*Assistant Examiner*—Terrence R. Till
*Attorney, Agent, or Firm*—Jacobson & Johnson

[57] ABSTRACT

A paint roller applicator to create in a user's mind that a paint roller applicator is a tool that can replace a paint brush for applying paint to large or small surfaces, with the invention including a socket housing for holding a paint roller frame, with the socket housing mountable on the base of a conventional paint brush handle, so that a user has a conventional paint brush handle as a hand grip on a paint roller applicator to acquaint the user that a paint roller applicator can be used on large or small surfaces. The user can mount the frame of the paint roller applicator directly in the base of the paint brush handle or in a socket housing that is frictionally held in the normal ferrule band on a flat blade paint brush handle with the socket housing including a member for interlocking connecting the frame of a paint roller applicator thereto and lips for holding my paint roller applicator on the edge of paint tray when the paint roller applicator is not in use.

10 Claims, 3 Drawing Sheets

PAINT ROLLER APPLICATORS

This application is a continuation of U.S. patent application Ser. No. 07/706,368, filed May 28, 1991, now abandoned.

FIELD OF THE INVENTION

This invention relates to paint roller applicators and, more specifically, to improvements in paint roller applicators which would induce a person to use a paint roller applicator instead of a paint brush.

BACKGROUND OF THE INVENTION

The concept of paint roller applicators is well known in the art. In general, a paint roller applicator includes a frame with a handle for the user to grasp the applicator, and a rotatable absorbent covering or roller mounted on the end of the frame to permit the user to rom paint on a surface. An alternate, older method of applying paint to a surface is use of a brush, in which the user dips its bristles into the paint and then spreads the paint on a surface. An advantage of paint roller applicators is that the user can apply paint over a large surface both quickly and evenly. Frequently, a user associates paint roller applicators with use on larger surfaces, since the length of most rollers ranges from four to nine inches. However, paint rollers with smaller diameters or shorter lengths are suitable for painting smaller surfaces. Unfortunately, a user automatically reaches for a paint brush to paint smaller surfaces, even though a paint roller applicator may exist for painting smaller surfaces. To induce a user to think about using a paint roller applicator where he or she would usually use a paint brush, the present invention provides a handle on the paint roller that a user immediately recognizes as a paint brush handle. The paint brush handle on the paint roller applicator induces a user to mentally associate a paint roller applicator for painting small surfaces as well as larger surfaces.

Paint roller applicators apply paint faster than brushes, but if a user is familiar only with larger nine- or ten-inch paint rollers and does not know that smaller two- or three-inch paint rollers are available and equally effective and efficient for painting small areas, such as window cases or door trim the user will select a brush. Paint rollers, whether large or small, offer a user an advantage over a brush since they hold more paint. Consequently, even though there are advantages to using small paint rollers oftentimes people may not use small paint rollers since they simply do not associate the use of a paint roller with painting small surfaces. Incorporating a feature of paint brushes into the paint roller applicator, the present invention is designed to induce a purchaser or user to substitute small paint roller applicators for small paint brushes.

Although the present invention is well suited for use with small applicators the present invention is equally well suited for use with large rollers.

DESCRIPTION OF THE PRIOR ART

U.S. Pat. No. 3,877,123 shows a unitary molded paint roller core structure for rotatable mounting a paint sleeve thereto. To hold the core on the axle of the paint roller applicator, has a recess for a securing means but no roller core securing means.

U.S. Pat. No. 3,711,887 shows a paint roller for attachment to an axle of a paint roller applicator, with a collet bearing press-fitted on the axle, until the collet bearing engages stop lugs on the axle of the paint roller. Bearing sleeves on the roller sleeve appear to rotatingly engage the outside of the collet bearing.

U.S. Pat. No. 2,747,210 shows a cage mechanism which uses a collar with a set screw to prevent the cage mechanism from sliding off the end of the axle.

U.S. Pat. No. 3,228,087 shows a plastic roller cage with pleats to support a paint roller. A nut holds the roller on the axle of the paint roller.

U.S. Pat. No. 3,447,184 shows a paint roller axle with an expandable gripper mass to permit a user to adjust the tightness between the paint roller core and the gripper mass.

U.S. Pat. No. 4,209,883 shows a plastic-molded roller cage of two parts joined by an integral hinge with a cap-type washer to hold the roller cage on the axle of the paint roller.

U.S. Pat. No. 2,669,742 shows a split cylinder with ears to engage the end closure members of the paint roller to provide a positive drive for the roller.

U.S. Pat. No. 4,316,301 shows a neck on the axle to engage the end cap of a paint roller.

U.S. Pat. No. 3,386,119 shows a paint brush with a flared handle and bristles held in the flared end by a tubular metal ferrule.

U.S. Pat. No. 2,854,684 shows a flared handle with a ferrule to hold the bristles on the flared end of the brush handle.

U.S. Pat. No. Des. 291,152 shows an ornamental roller cover support for a paint roller.

BRIEF SUMMARY OF THE INVENTION

Briefly, the present invention comprises an improvement to paint roller applicators that suggests to a user that he or she can use a paint roller applicator to paint smaller surfaces, as well as assists novice painters in recognizing that they can substitute small paint roller applicators for small paint brushes. The present invention includes a socket housing that holds the paint roller, frame, with the socket housing mountable to the handle of a conventional paint brush handle, which offers a user a conventional paint brush handle as a hand grip or hand grasping portion on a paint roller applicator. The paint brush handle on the paint roller applicator makes a novice user of my paint roller applicator comfortable in using the paint roller applicator, as well as offering the conventional feel and control of paint brushes common to the seasoned user. The socket housing is frictionally held in the normal ferrule band on a paint brush, with the socket housing including a member for connecting the frame of a paint roller applicator thereto, and lips for holding my paint roller applicator on the edge of paint tray when the paint roller applicator is not in use.

DESCRIPTION OF THE PREFERRED EMBODIMENT

Figure 1:
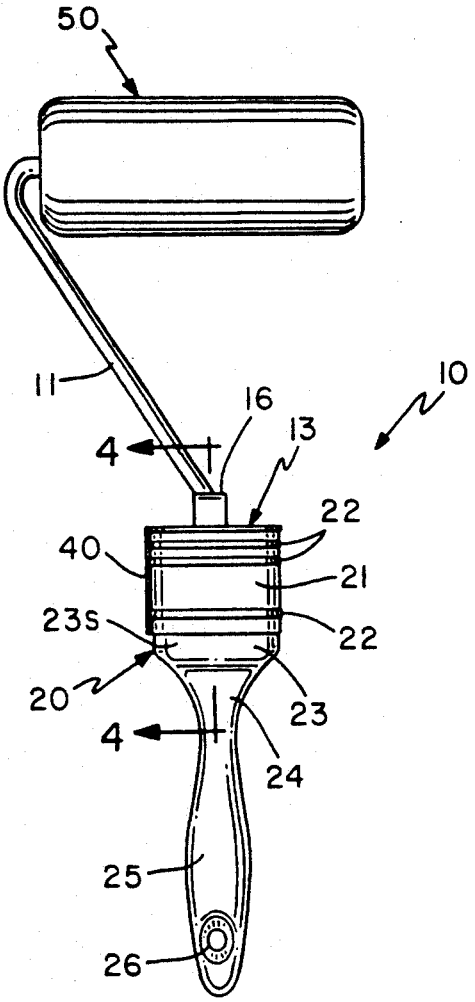
FIG. 1 shows a front view of a paint roller applicator with a conventional flat blade paint brush handle.

FIG. 1 shows a front view of my invention. Reference numeral 10 identifies a paint roller applicator having a wire frame I 1, a paint roller 50, an elongated socket housing 13, and a flat blade paint brush handle 20. Paint roller 50 is rotatably mounted on frame 11 to permit a user to roll paint from roller 50 onto a surface. The paint brush handle 20 comprises a rigid cylindrical elongated base 23 in the shape of a flat blade with a neck 24 that extends from base 23 into a larger hand-grasping portion or hand gripping area 25. The end of handle 20 includes a hole 26 to permit a user to hang paint roller applicator 10 by handle 20.

An elongated cylindrical metal ferrule 21 tightly encircles outer surface portion 23*s* of base 23 and outer surface portion 15*s* of socket housing 13 to hold elongated socket housing 13 and base 23 proximate each other as if they were an integral elongated unit. Located encircling ferrule 21 are a series of raised bands 22 that add stiffness to the metal ferrule 2 1. A conventional crimped joint 40 extends along the side of metal ferrule 2 1 to tightly hold metal ferrule 21 around a base 15 on socket housing 13. In a conventional paint brush, socket housing 13 would be replaced by a clump of bristles used for applying paint to a surface.

Figure 2:
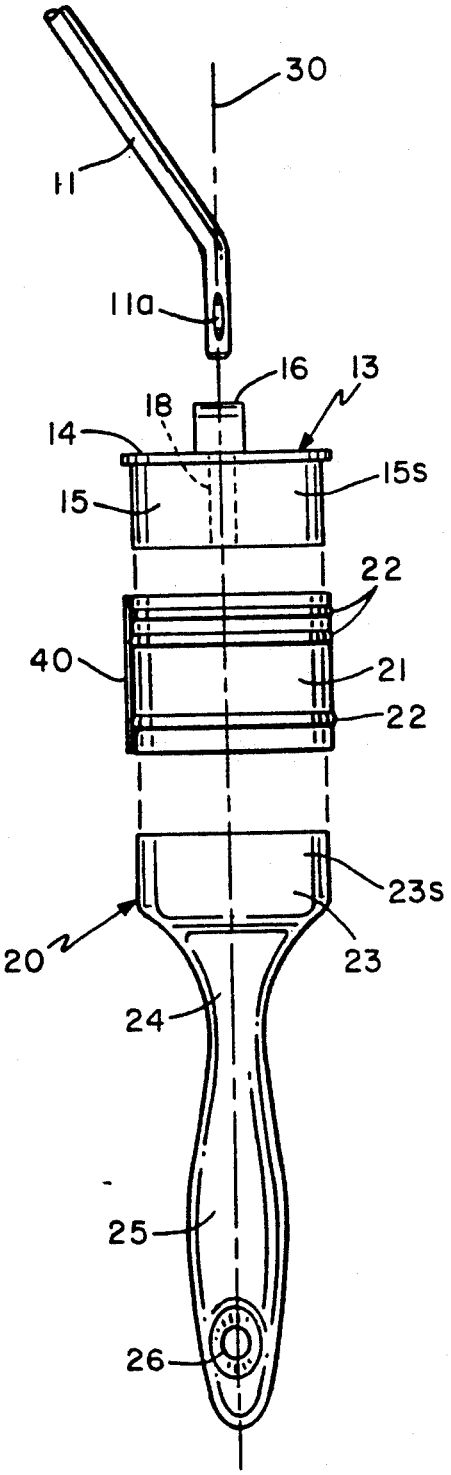
FIG. 2 shows a partial exploded view of the paint roller applicator of FIG. 1
Figure 3:
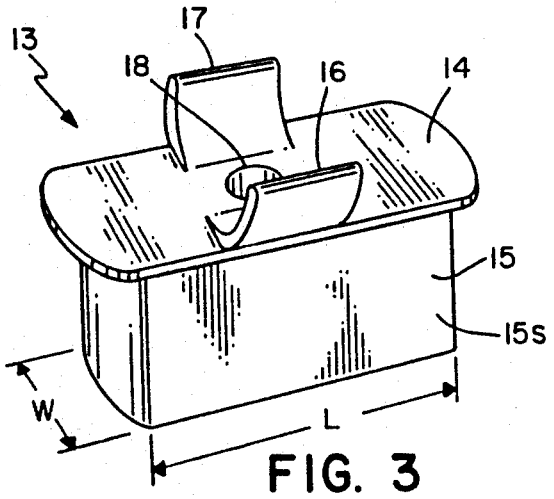
FIG. 3 shows a perspective view of the socket housing for converting a conventional flat blade paint brush handle into a paint roller frame.

FIG. 2 shows an exploded partial view of my paint roller applicator 10 and socket housing 13 with FIG. 3 showing a perspective view of socket housing 13. Socket housing 13 has a lower elongated cylindrical housing or base 15 that is normally held tightly by metal ferrule 2 1. Cylindrical housing 13 is substantially rigid and has an elongated shape with a length L that is longer than the width W of socket housing 13 and forms a flat blade that is substantially identical in length and width to base 23 of paint brush handle 20. Located on one end of socket housing 13 is a ledge 14 that extends over the top edge of metal ferrule 21. Extending into socket housing 13 is an opening 18 for receiving the end of the wire frame of a paint roller applicator 10. Opening 18 is symmetrically located with respect to a central axis 30 extending through paint brush handle 20 and socket housing 13. A first ear 16 is on one side of socket housing 13 and a second ear 17 (FIG. 3) is on the opposite side of socket housing 13. Ears 16 and 17 permit a user to rest paint roller applicator 10 on the edge of a paint tray and prevents the paint roller applicator from accidentally rolling into the paint tray and getting paint on the handle of the applicator.

Figure 4:
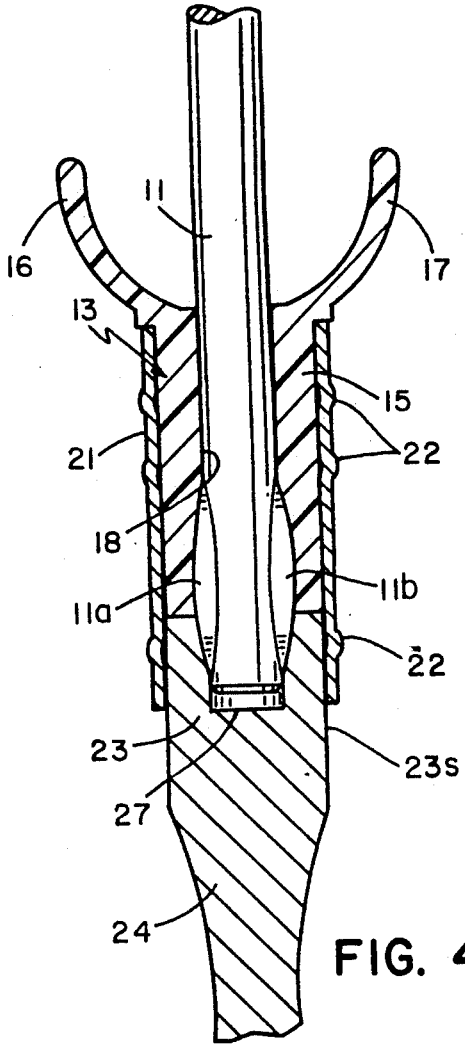
FIG. 4 shows a sectional view taken along fines 4—4 showing my socket housing mounted on a flat blade paint brush handle.

FIG. 4 shows a partial sectional view of paint roller applicator 10 taken along lines 4—4 of FIG. 1. Metal ferrule 21 encompasses a portion of base 23 and a portion of socket housing 13 to hold socket housing 13 and base 23 as a unitary piece. A pair of diametrical opposite swages 11*a* and 11*b* that interlock with socket housing 13 are on the end of wire frame I 1; that is, swages 11*a* and 1 lb project beyond the normal diameter of opening 18 to interlock physically with socket housing 13 and handle 24 to prevent axial rotation of wire frame 11 in opening 18 in socket housing 13. In the embodiment shown, the end of frame 11 was physically forced into socket housing 13 and the end of frame 1 1 into hole 27 in handle 24 to provide greater strength. Preferably, socket housing 13 is made of a rigid, but sufficiently deformable polymer plastic to permit a user to insert end of frame I 1 into interlocking engagement with socket housing 13. Alternately, a user could mold a socket housing around swages 11*a* and 11*b* to provide interlocking engagement and thereby prevent axial rotation of frame 1 1 in socket housing 13.

Figure 5:
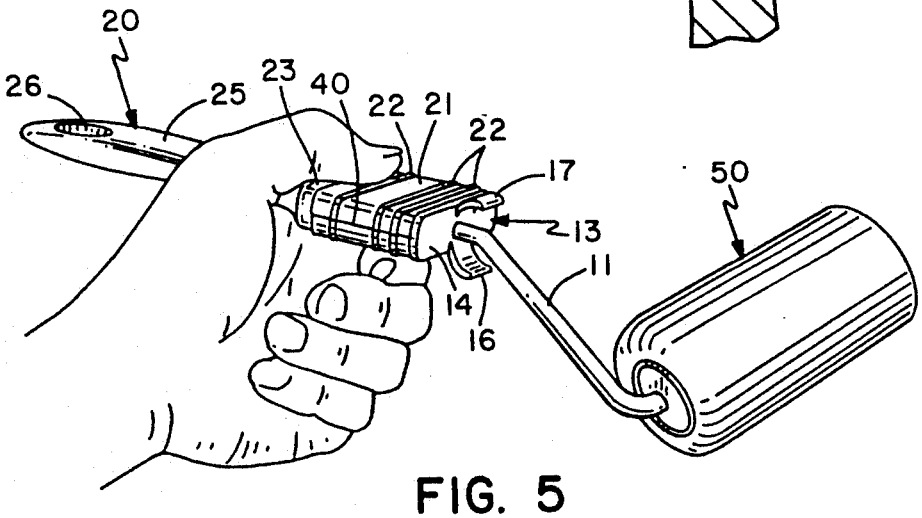
FIG. 5 shows a person's hand grasping and holding my invention.

FIG. 5 shows a user grasping flat blade paint brush handle 20 of my invention in a manner that he or she normally grasps a paint brush handle; that is, the thumb and forefinger extend to opposite sides of the blade portion to give the user a grasp and control of paint brush handle 20. The base or blade portion 23 of handle 20 is in a plane parallel to the rotational axis of paint roller 50. The advantage of a paint brush handle with a flat blade portion that extends outward from the axis of frame 1 1 over the conventional round paint roller handles is that the flat blade gives a user greater hand leverage on positioning paint roller applicator 50 on a surface.

Familiarity with holding and manipulating conventional paint brush handles quickly suggests to a potential user that he or she can use a paint roller applicator to paint smaller surfaces as well as larger surfaces. Once the user begins to paint with my invention, he or she quickly acquires the skill to use a paint roller applicator properly. At that point, the user may want to use a paint roller applicator with a conventional handle, or he or she may prefer the paint roller applicator with my paint brush handle and continue to use my paint roller applicator.

Figure 6:
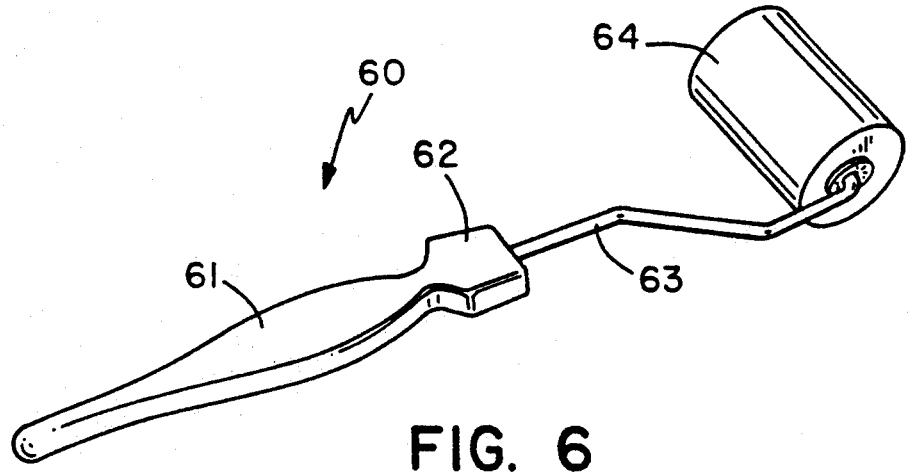
FIG. 6 shows a perspective view of a first alternate embodiment of the present invention.

FIG. 6 shows a first alternate embodiment of my invention, comprising a Kaiser brush handle having a hand-grasping portion gripping area 61 with a base area 62 that normally connects to bristles that form the working head of a paint brush. Instead of bristles mounted in base area 62, base area 62 includes a wire frame 63 having one end mounted in base area 62 and the other end rotatably supporting a roller 64.

Figure 7:
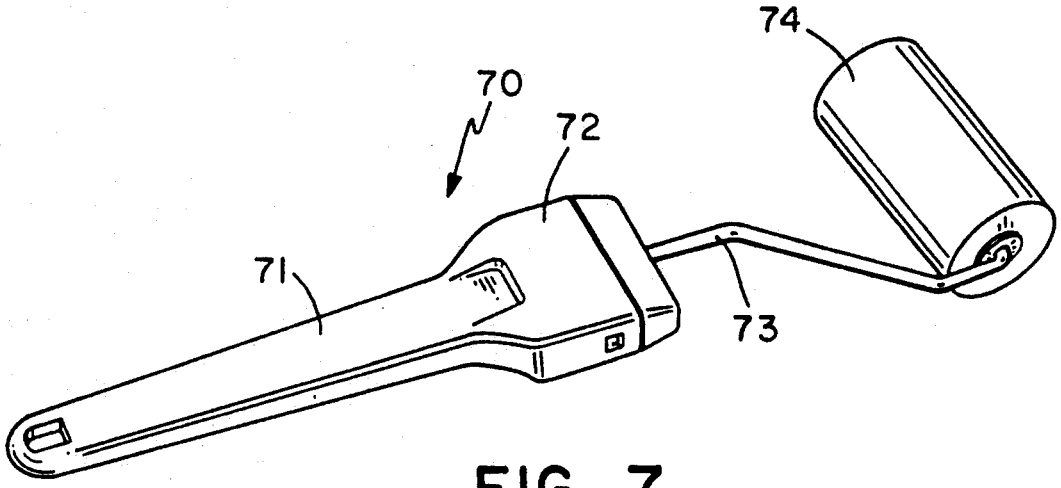
FIG. 7 shows a perspective view of a second alternate embodiment of the present invention.

FIG. 7 also shows a second alternate embodiment of my invention, comprising an elongated tapered brush handle, having a hand-grasping portion 71 with a base area 72 that normally connects to bristles that form the working head of a paint brush. Instead of bristles mounted in base area 72, base area 72 includes a wire frame 73, having one end mounted in base area 72 and the other end rotatably supporting a roller 74.

Figure 8:
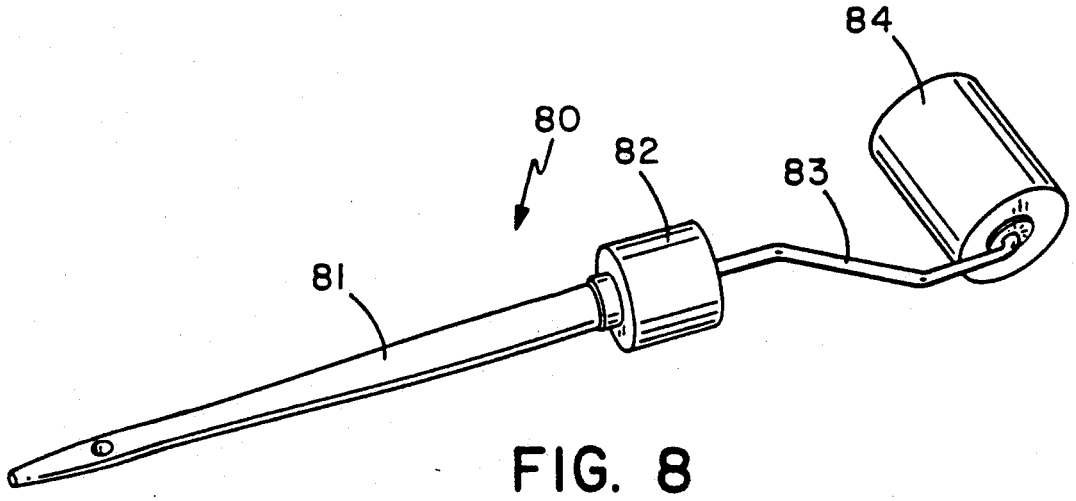
FIG. 8 shows a perspective view of a third alternate embodiment of the present invention.

FIG. 8 is a third alternate embodiment of my invention, comprising a conical shaped brush handle, having a hand-grasping portion 81 with a base area 82 that normally connects to bristles that form the working head of a paint brush. Instead of bristles mounted in base 82, base 82 includes a wire frame 83 having one end mounted in base 82 and the other end rotatably supporting a roller 84.

FIG. 1 shows the preferred embodiment of my invention that uses a flat blade paint brush handle 20 which the industry refers to as a "beaver-tail handle."

FIG. 1, FIG. 6, FIG. 7, and FIG. 8 show applicators 20, 60, 70, and 80 to illustrate typical variation in paint brush handles, yet a user quickly recognizes the handles as paint brush handles normally used in conjunction with a clump of bristles. In each case , the paint brush handle includes a hand-grasping portion for a user's hand and a base that connects to a shaped clump of bristles that may be rectangular, round, or oval. In most paint brushes, the base connecting the bristles is generally wider than the hand-grasping portion of the handle. While I have shown different shaped handles for paint brushes, most users instantly recognize the handles on the paint roller applicators are conventional paint brush handles.

I claim:

1. A paint roller applicator for teaching a person to use a paint roller to paint surfaces usually painted with a brush by having the paint roller applicator with a handle shaped like a handle on a paint brush, comprising:

a paint roller frame, said frame having a first end and a second end;

a cylindrical paint roller rotatably attached on its longitudinal axis to said first end of said paint roller frame to permit a user to roll paint on a surface;

a paint brush handle having a hand-grasping potion attached to a base, said base substantially wider than said hand-grasping portion for greater hand leverage;

a socket housing having a length substantially the same as the width of said paint brush handle base, said socket housing resting on said paint brush handle base;

a ferrule surrounding said paint brush handle base and said socket housing securely holding said socket housing onto said base; and a generally centrally located opening extending into said socket housing for insertion of the second end of said paint roller frame, said second end having swaged members for forming interlocking nonrotatable engagement with said socket housing opening to hold said paint roller frame secure to said paint brush handle to permit a user to move the paint roller over a surface by holding the hand-grasping portion of the paint brush handle.

2. The paint roller applicator of claim 1 wherein said socket housing extends in an elongated direction that is substantially in the same plane as the axis of rotation of said roller.

3. The paint roller applicator of claim 1 wherein said socket housing is a polymer plastic and said paint brush handle is wood.

4. The paint roller applicator of claim 1 wherein said socket housing includes external opposite facing curved ears extending from said socket housing over said ferrule for resting said paint roller applicator on an edge of a paint roller applicator tray.

5. The paint roller applicator of claim 1 wherein said socket housing includes a ledge extending over the edge of said ferrule.

6. A paint roller applicator for teaching a person to use a paint roller to paint surfaces usually painted with a brush by having the paint roller applicator with a handle shaped like a handle on a paint brush comprising:

a paint roller applicator frame for joining to a conventional paint brush handle, said handle having a hand-grasping portion and a base portion which is substantially wider than said hand-grasping portion;

a rigid, cylindrical member, said cylindrical member having an opening for receiving a swaged end of the paint applicator roller frame and for forming interlocking nonrotating engagement with said swaged end of the paint roller applicator frame for rotatably supporting a paint roller on said frame, said cylindrical member resting on the base of a paint brush handle; and a ferrule surrounding said cylindrical member and surrounding said base of the paint brush handle for attaching said cylindrical member to said base whereby a user can control and manipulate the paint roller with the paint brush handle for greater hand leverage.

7. The invention as described in claim 6 wherein said cylindrical member is made of a polymer plastic.

8. The invention as described in claim 6 wherein said cylindrical member includes a ledge for extending over an edge of the ferrule.

9. The invention as described in claim 6 wherein said cylindrical member includes opposite facing curved ears extending from said ledge for resting said paint roller applicator on an edge of a paint roller tray.

10. A paint roller applicator for teaching a person to use a paint roller to paint surfaces usually painted with a brush by having the paint roller applicator with a handle shaped like a handle on the paint brush comprising:

a paint roller frame, said frame having a first end and a second end;

a paint roller extending over and rotatably attached to said first end of said frame to permit a user to roll paint on a surface, said paint roller having an axis of rotation extending therethrough; and a paint brush handle having a hand-grasping portion and a base, said base wider than said hand-grasping portion for greater hand leverage, said base having means for holding said frame in a nonrotatable position in said paint brush handle to permit a person to roll paint on a surface while using said paint brush handle to guide the paint roller applicator over a surface being painted.

* * * * *